US010199145B2

(12) United States Patent
Shoji et al.

(10) Patent No.: US 10,199,145 B2
(45) Date of Patent: Feb. 5, 2019

(54) RARE-EARTH MAGNET AND METHOD FOR PRODUCING THE SAME

(71) Applicant: TOYOTA JIDOSHA KABUSHIKI KAISHA, Toyota-shi, Aichi (JP)

(72) Inventors: Tetsuya Shoji, Toyota (JP); Akira Manabe, Miyoshi (JP); Noritaka Miyamoto, Toyota (JP); Motoki Hiraoka, Toyota (JP); Shinya Omura, Nagakute-cho (JP); Daisuke Ichigozaki, Toyota (JP); Shinya Nagashima, Toyota (JP)

(73) Assignee: TOYOTA JIDOSHA KABUSHIKI KAISHA, Toyota-shi, Aichi (JP)

( * ) Notice: Subject to any disclaimer, the term of this patent is extended or adjusted under 35 U.S.C. 154(b) by 208 days.

(21) Appl. No.: 14/237,702

(22) PCT Filed: Nov. 12, 2012

(86) PCT No.: PCT/JP2012/079203
§ 371 (c)(1),
(2) Date: Feb. 7, 2014

(87) PCT Pub. No.: WO2013/073486
PCT Pub. Date: May 23, 2013

(65) Prior Publication Data

US 2014/0242267 A1 Aug. 28, 2014

(30) Foreign Application Priority Data

Nov. 14, 2011 (JP) ..... 2011-248777
Nov. 14, 2011 (JP) ..... 2011-248994

(51) Int. Cl.
*H01F 1/055* (2006.01)
*C22C 28/00* (2006.01)
(Continued)

(52) U.S. Cl.
CPC ..... *H01F 1/055* (2013.01); *B22F 3/162* (2013.01); *B22F 3/26* (2013.01); *C22C 28/00* (2013.01);
(Continued)

(58) Field of Classification Search
CPC ..... H01F 41/0293; H01F 1/055; C22C 28/00
(Continued)

(56) References Cited

U.S. PATENT DOCUMENTS 4,792,367 A 12/1988 Lee
5,129,963 A 7/1992 Panchanathan et al.
(Continued)

FOREIGN PATENT DOCUMENTS

CN 1234589 A 11/1999
CN 101521068 A 9/2009
(Continued)

OTHER PUBLICATIONS

Translation of JP 2005-209932.
(Continued)

*Primary Examiner* — Weiping Zhu
(74) *Attorney, Agent, or Firm* — Sughrue Mion, PLLC

(57) ABSTRACT

Provided is a rare-earth magnet containing no heavy rare-earth metals such as Dy or Tb in a grain boundary phase, has a modifying alloy for increasing coercivity (in particular, coercivity under a high-temperature atmosphere) infiltrated thereinto at lower temperature than in the conventional rare-earth magnets, has high coercivity, and has relatively high magnetizability, and a production method therefor. The rare-earth magnet RM includes a RE-Fe—B-based main phase MP with a nanocrystalline structure (where RE is at least one of Nd or Pr) and a grain boundary phase BP around the main phase, the grain boundary phase containing a RE-X alloy (where X is a metallic element other than heavy
(Continued)

rare-earth elements). Crystal grains of the main phase MP are oriented along the anisotropy axis, and each crystal grain of the main phase, when viewed from a direction perpendicular to the anisotropy axis, has a plane that is quadrilateral in shape or has a close shape thereto.

6 Claims, 7 Drawing Sheets

(51) Int. Cl.

| | |
|---|---|
| ***H01F 1/057*** | (2006.01) |
| ***H01F 41/02*** | (2006.01) |
| ***B22F 3/16*** | (2006.01) |
| ***B22F 3/26*** | (2006.01) |
| ***C22F 1/16*** | (2006.01) |
| *B22F 3/10* | (2006.01) |

(52) U.S. Cl.
CPC ..... *C22F 1/16* (2013.01); *H01F 1/0577* (2013.01); *H01F 41/0253* (2013.01); *B22F 3/10* (2013.01); *B22F 2998/10* (2013.01); *H01F 41/0293* (2013.01)

(58) Field of Classification Search
USPC ..... 335/302
See application file for complete search history.

(56) References Cited

U.S. PATENT DOCUMENTS

| | | | |
|---|---|---|---|
| 8,846,136 | B2 | 9/2014 | Shoji et al. |
| 9,257,227 | B2 | 2/2016 | Haga et al. |
| 2003/0136469 | A1 | 7/2003 | Makita et al. |
| 2006/0022175 | A1 | 2/2006 | Komuro et al. |
| 2006/0054245 | A1 | 3/2006 | Liu et al. |
| 2006/0278517 | A1 | 12/2006 | Machida et al. |
| 2007/0240789 | A1 | 10/2007 | Nakamura et al. |
| 2008/0223489 | A1 | 9/2008 | Nagata et al. |
| 2009/0020193 | A1 | 1/2009 | Ohta et al. |
| 2010/0003156 | A1 | 1/2010 | Suzuki et al. |
| 2011/0000586 | A1 | 1/2011 | Nomura et al. |
| 2011/0036460 | A1 | 2/2011 | Nagata et al. |
| 2012/0299675 | A1 | 11/2012 | Honkura et al. |
| 2012/0312422 | A1 | 12/2012 | Yano et al. |
| 2013/0009736 | A1 | 1/2013 | Honkura et al. |
| 2013/0078369 | A1 | 3/2013 | Shoji et al. |
| 2013/0195710 | A1 | 8/2013 | Raga et al. |
| 2014/0308441 | A1 | 10/2014 | Shoji et al. |
| 2015/0228386 | A1 | 8/2015 | Sakuma et al. |
| 2015/0278529 | A1 | 10/2015 | Ichigozaki et al. |
| 2015/0279529 | A1 | 10/2015 | Ichigozaki et al. |
| 2015/0279559 | A1 | 10/2015 | Miyamoto et al. |
| 2015/0287528 | A1 | 10/2015 | Haga et al. |
| 2016/0141083 | A1 | 5/2016 | Ito et al. |

FOREIGN PATENT DOCUMENTS

| | | | |
|---|---|---|---|
| CN | 103227019 | A | 7/2013 |
| EP | 1 970 924 | A1 | 9/2008 |
| JP | 2-208902 | A | 8/1990 |
| JP | 5-182851 | A | 7/1993 |
| JP | 06-231926 | A | 8/1994 |
| JP | 7-283016 | A | 10/1995 |
| JP | 8-250356 | A | 9/1996 |
| JP | 8-316014 | A | 11/1996 |
| JP | 9-275004 | A | 10/1997 |
| JP | 2693601 | B2 | 12/1997 |
| JP | 10-172850 | A | 6/1998 |
| JP | 11-329810 | A | 11/1999 |
| JP | 3033127 | B2 | 4/2000 |
| JP | 2003-229306 | A | 8/2003 |
| JP | 2007-517414 | A | 6/2007 |
| JP | 2008-263179 | A | 10/2008 |
| JP | 2010-98115 | A | 4/2010 |
| JP | 2010-114200 | A | 5/2010 |
| JP | 4482769 | B2 | 6/2010 |
| JP | 2010-263172 | A | 11/2010 |
| JP | 2011-14668 | A | 1/2011 |
| JP | 2011-35001 | A | 2/2011 |
| JP | 2011-61038 | A | 3/2011 |
| JP | 4656323 | B2 | 3/2011 |
| JP | 2011061038 | A * | 3/2011 |
| JP | 2011-159733 | A | 8/2011 |
| JP | 4748163 | B2 | 8/2011 |
| JP | 2012-234985 | A | 11/2012 |
| JP | 2013-105903 | A | 5/2013 |
| JP | 5196080 | B2 | 5/2013 |
| JP | 2013-175705 | A | 9/2013 |
| KR | 10-2012-0135337 | A | 12/2012 |
| WO | 2011/070827 | A1 | 6/2011 |
| WO | 2011/070847 | A1 | 6/2011 |
| WO | 2012/036294 | A1 | 3/2012 |

OTHER PUBLICATIONS

Communication from United States Patent and Trademark Office dated Nov. 12, 2015 in co-pending U.S. Appl. No. 14/355,389.
Communication from United States Patent and Trademark Office dated Jul. 25, 2016, in U.S. Appl. No. 14/441,695.
Communication from United States Patent and Trademark Office dated May 26, 2016, in U.S. Appl. No. 14/437,898.
Communication from United States Patent and Trademark Office issued Jul. 29, 2016, in U.S. Appl. No. 14/437,898.
Communication from United States Patent and Trademark Office dated Jul. 29, 2016, in U.S. Appl. No. 14/610,229.
Communication from United States Patent and Trademark Office dated Mar. 2, 2017, in U.S. Appl. No. 14/437,898.
Communication dated Dec. 12, 2016, issued by the U.S. Patent and Trademark Office in related U.S. Appl. No. 14/441,695.
Communication dated Dec. 12, 2016, issued by the U.S. Patent and Trademark Office in related U.S. Appl. No. 14/610,229.
Communication dated Apr. 12, 2017 from the U.S. Patent and Trademark Office in U.S. Appl. No. 14/610,229.
Communication dated Oct. 2, 2017, issued by the U.S. Patent and Trademark Office in related U.S. Appl. No. 14/610,229.
Communication dated Jan. 26, 2018, from the U.S. Patent and Trademark Office in U.S. Appl. No. 14/610,229.
C. Mishima, et al., "Development of a Dy-Free NdFeB Anisotropic Bonded Magnet with a High Thermal Stability", Proceedings of the 21st Workshop on Rare-Earth Permanent Magnets and their Applications, 2010, p. 253-256, REPM '10.
K. Makita, et al., "Boundary Structure and the Local Crystalline Electric Field of Nd—Fe—B Sintered Magnets", Journal of Magnetics Society of Japan, Oct. 1, 2002, pp. 1060-1067, vol. 26, No. 10.
S. Hirosawa, et al., "Recent Efforts Toward Rare-Metal-Free Permanent Magnets in Japan", Proceedings of the 21st Workshop on Rare-Earth Permanent Magnets and their Applications, 2010, pp. 187-191, REPM '10.
Tomoki Fukugawa, "Nd/NdFeB Artificial Interface Microstructure and the Intrinsic Coercivity of Surface $Nd_2Fe_{14}B$ Grains", NEOMAX Company, Hitachi Metals Ltd., Mar. 2008. pp. 40-45, vol. 24.
W.F. Li, et al., "The role of Cu addition in the coercivity enhancement of sintered Nd—Fe—B permanent magnets", J. Mater. Res., Feb. 2009, pp. 413-419, vol. 24, No. 2.
Wenjian Mo, et al., "Dependence of the crystal structure of the Nd-rich phase on oxygen content in an Nd—Fe—B sintered magnet", Scripta Materialia, pp. 179-182, vol. 59.

* cited by examiner

Fig. 2
(a)
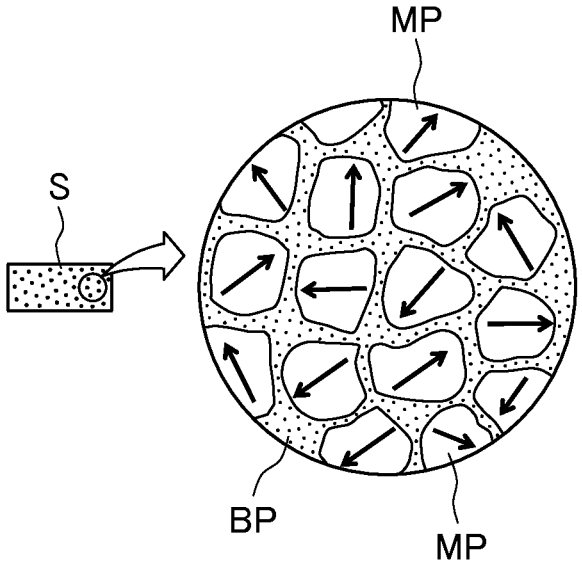
(b)
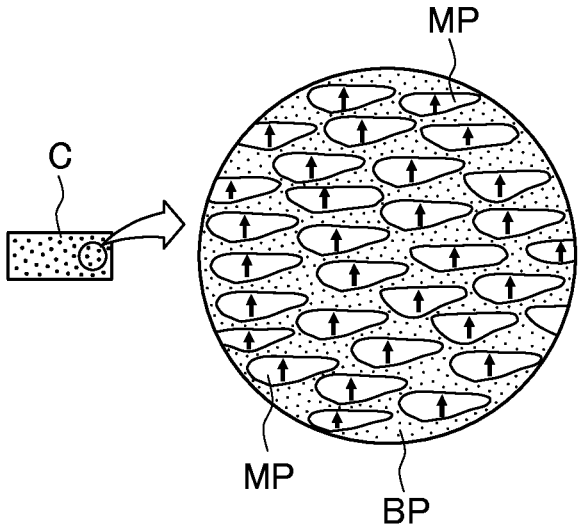

◇ : 575°C, 120 Minutes
□ : 600°C, 120 Minutes
△ : 625°C, 120 Minutes
○ : 650°C, 120 Minutes
× : Base Magnet
Magnetization (T)
1.45
1.4
1.35
1.3
1.25
1.2
1.15
1.1
1.05
1.0
Y1
Y2
5%
10%
15%
20%
15
(1194)
17.5
(1393)
20
(1592)
22.5
(1791)
25
(1990)
27.5
(2189)
Coercivity (kOe)
Values in ( ) Indicate kA/m Equivalents

RARE-EARTH MAGNET AND METHOD FOR PRODUCING THE SAME

CROSS REFERENCE TO RELATED APPLICATIONS

This application is a National Stage of International Application No. PCT/JP2012/079203, filed on Nov. 12, 2012, which claims priority from Japanese Patent Application Nos. 2011-248994 and 2011-248777, both filed on Nov. 14, 2012, the contents of all of which are incorporated herein by reference in their entirety.

TECHNICAL FIELD

The present invention relates to a rare-earth magnet and a method for producing the same.

BACKGROUND ART

Rare-earth magnets that use rare-earth elements, such as lanthanoid, are also called permanent magnets. Such magnets are used not only for hard disks or motors of MRI but also for driving motors of hybrid vehicles, electric vehicles, and the like.

As examples of magnetic performance indices of such rare-earth magnet, residual magnetization (i.e., residual magnetic flux density) and coercivity can be given. However, with a reduction in the motor size and an increase in the amount of heat generation that has been achieved with an increase in the current density, there has been an increasing demand for higher heat resistance of the rare-earth magnet being used. Thus, how to retain the coercivity of a magnet under high-temperature use environments is an important research object to be achieved in the technical field. For example, for a Nd—Fe—B-based magnet, which is one of the rare-earth magnets that are frequently used for vehicle driving motors, attempts have been made to increase the coercivity by, for example, reducing the crystal grain size, using an alloy with a high Nd content, or adding a heavy rare-earth element with high coercivity performance, such as Dy or Tb.

Examples of rare-earth magnets include typical sintered magnets whose crystal grains (i.e., a main phase) that form the structure have a scale of about 3 to 5 and nanocrystalline magnets whose crystal grains have been reduced in size down to a nano-scale of about 50 to 300 nm. Among them, nanocrystalline magnets for which the amount of addition of an expensive heavy rare-earth element can be reduced (i.e., reduced to zero) while the crystal grain size can also be reduced as described above are currently attracting attention.

The resource cost of Dy, which is frequently used among heavy rare-earth elements, has been rapidly increasing since the Japanese fiscal year 2011 as the prospecting areas of Dy are mostly distributed in China and the amount of production as well as the amount of exports of rare metals, such as Dy, by China is now regulated. Therefore, development of a magnet with a less Dy content, which has a reduced Dy content but has ensured coercive performance, and a Dy-free magnet, which contains no Dy but has ensured coercive performance, is one of the important development tasks to be achieved, and this has been one of the factors that are increasing the degree of attention of nanocrystalline magnets.

A method for producing a nanocrystalline magnet is briefly described below. For example, a sintered body is produced by sintering nano-sized fine powder, which has been obtained through liquid quenching of a melt of a Nd—Fe—B-based metal, while at the same time performing pressure molding, and then performing hot plastic processing to the sintered body to impart magnetic anisotropy thereto, whereby a molded body is produced.

A heavy rare-earth element with high coercivity performance is imparted to such a molded body by various methods, whereby a rare-earth magnet made of a nanocrystalline magnet is produced. Patent Literature 1 and 2 each disclose examples of such production method.

First, Patent Literature 1 discloses a production method that includes evaporating an evaporation material, which contains at least one of Dy or Tb, onto a molded body that has been obtained through hot plastic processing, and diffusing the evaporation material into the grain boundaries from the surface of the molded body.

This production method requires high-temperature treatment at about 850 to 1050° C. in the step of evaporating the evaporation material. Such a temperature range has been defined so as to improve the residual magnetic flux density and suppress the grain growth at a too high speed.

However, when heat treatment is performed in the temperature range as high as about 850 to 1050° C., the crystal grains will become coarse, which can result in decreased coercivity with high probability. That is, even though Dy or Tb is diffused into the grain boundaries, it becomes consequently impossible to sufficiently increase the coercivity.

Meanwhile, Patent Literature 2 discloses a production method that includes bringing an at least one element selected from Dy, Tb, and Ho, or an alloy containing such element and at least one element elected from Cu, Al, Ga, Ge, Sn, In, Si, P, and Co into contact with the surface of a rare-earth magnet, and diffusing the element or the alloy into the grain boundaries by applying heat treatment such that the grain size will not become greater than 1 μm.

Herein, Patent Literature 2 discloses that when the temperature of the heat treatment is in the range of 500 to 800° C., it is possible to achieve an excellent balance between the effect of diffusion of Dy or the like into the crystal grain boundary phase and the effect of suppressing coarsening of the crystal grains due to the heat treatment, whereby a rare-earth magnet with high coercivity can be easily obtained. In addition, Patent Literature 2 discloses various embodiments in which Dy-Cu alloys are used and heat treatment at 500 to 900° C. is performed. Among the various embodiments, a 85 Dy-15 Cu alloy, which is a representative example, has a melting point of about 1100° C. However, in order to diffuse and infiltrate a metal melt of such an alloy, it would be necessary to perform high-temperature treatment at about 1000° C. or greater. Consequently, it would be impossible to suppress coarsening of the crystal grains.

Thus, since the alloy in Patent Literature 2 when heat treatment in the range of 500 to 800° C. is performed is in the solid phase, and Dy—Cu alloys and the like are diffused into the rare-earth magnet through solid-phase diffusion, it is easily understood that the diffusion takes a long time.

In view of the foregoing various circumstances (e.g., the costs of Dy and the like are increasing; crystal grains will become coarse under a high-temperature atmosphere when a modifying alloy containing a high-melting-point heavy rare-earth element is diffused into the grain boundary phase; and solid-phase diffusion of such a modifying alloy takes a long time), the inventors have arrived at a rare-earth magnet made of a nanocrystalline magnet that contains no heavy rare-earth metals such as Dy or Tb in the grain boundary phase, has high coercivity, in particular, high coercivity under a high-temperature atmosphere, and has relatively high magnetizability, and a method for producing such a magnet.

CITATION LIST

Patent Literature

Patent Literature 1: JP 2011-035001 A
Patent Literature 2: JP 2010-114200 A

SUMMARY OF INVENTION

Technical Problem

The present invention has been made in view of the foregoing problems. It is an object of the present invention to provide a rare-earth magnet that contains no heavy rare-earth metals such as Dy or Tb in the grain boundary phase, has a modifying alloy for increasing coercivity (in particular, coercivity under a high-temperature atmosphere) that has been infiltrated thereinto at a lower temperature than in the conventional rare-earth magnets, has high coercivity, and has relatively high magnetizability, and a method for producing such a magnet.

Solution to Problem

In order to achieve such an object, the rare-earth magnet in accordance with the present invention includes a RE-Fe—B-based main phase with a nanocrystalline structure (where RE is at least one of Nd or Pr) and a grain boundary phase around the main phase, the grain boundary phase containing a RE-X alloy (where X is a metallic element other than heavy rare-earth elements). The crystal grains of the main phase are oriented along the anisotropy axis, and each crystal grain of the main phase, when viewed from a direction perpendicular to the anisotropy axis, has a plane that is quadrilateral in shape or has a close shape thereto.

The rare-earth magnet of the present invention relates to a rare-earth magnet with a nanocrystalline structure, and contains no heavy rare-earth metals such as Dy or Tb in the grain boundary phase. Such a rare-earth magnet has high coercivity, in particular, high coercivity under a high-temperature atmosphere (e.g., 150 to 200° C.), and has relatively high magnetizability.

As a method for producing such a rare-earth magnet, a quenched thin strip (i.e., a quenched ribbon) that contains fine crystal grains is first produced through liquid quenching. Then, a die is filled with the quenched thin strip, and sintering is performed while at the same time applying pressure with a punch to obtain a bulk. Thus, an isotropic sintered body is obtained that includes a RE-Fe—B-based main phase with a nanocrystalline structure (where RE is at least one of Nd or Pr, more specifically, one or more of Nd, Pr, or Nd—Pr), and a grain boundary phase around the main phase, the grain boundary phase containing a RE-X alloy (where X is a metallic element).

Then, hot plastic processing is applied to the sintered body to impart anisotropy thereto, whereby a molded body is produced. During the hot plastic processing, adjustment of not only the processing temperature and the processing time, but also the plastic strain rate is an important factor.

In such a molded body, the RE-X alloy that forms the grain boundary phase would differ depending on the components of the main phase. When RE is Nd, the RE-X alloy is an alloy of Nd and at least one of Co, Fe, or Ga, and for example, contains one of Nd—Co, Nd—Fe, Nd—Ga, Nd—Co—Fe, or Nd—Co—Fe—Ga, or a mixture of two or more of them, and thus is in the Nd-rich state. It should be noted that when RE is Pr, the RE-X alloy is in the Pr-rich state as in the case where RE is Nd.

The inventors have identified that the melting point of the grain boundary phase that contains Nd—Co, Nd—Fe, Nd—Ga, Nd—Co—Fe, or Nd—Co—Fe—Ga, or a mixture thereof is generally about 600° C. (i.e., in the range of about 550 to 650° C. since the melting point will vary depending on the components and the ratio thereof). It should be noted that the crystal grain size of the main phase is preferably in the range of 50 to 300 nm. This is based on the finding of the inventors that when a main phase in such a grain size range is applied to a nanocrystalline magnet, there will be no increase in the grain size.

Next, the grain boundary phase of the molded body is melted, and a melt of a RE-Z alloy (where RE is at least one of Nd or Pr, and Z is a metallic element other than heavy rare-earth elements) is caused to liquid-phase infiltrate from the surface of the molded body, whereby the melt of the RE-Z alloy is absorbed into the grain boundary phase in the molten state, and a change in the inner structure of the molded body occurs, whereby a rare-earth magnet with increased coercivity is produced. It should be noted that it is also possible to use a method of bringing a chip of a RE-Z alloy into contact with the molded body, melting the RE-Z alloy, and thus causing liquid-phase infiltration of the melt of the RE-Z alloy from the surface of the molded body. In such a case, if a chip with dimensions that correspond to a desired amount of a melt of the RE-Z alloy is used, it becomes possible to elaborately and easily control the amount of infiltration of the melt.

For the RE-Z alloy in the molten state, which is caused to liquid-phase infiltrate into the grain boundary phase in the molten state from the surface of the molded body, it is desirable to select a Nd alloy with about an equal melting point to that of the grain boundary phase. Thus, a melt of a Nd alloy in the range of about 600 to 650° C. is caused to infiltrate into the grain boundary phase in the molten state. Accordingly, it becomes possible to significantly improve the diffusion efficiency and the diffusion speed than when Dy—Cu alloys and the like are solid-phase diffused into the grain boundary phase, whereby diffusion of a modifying alloy in a short time becomes possible.

As described above, since a modifying alloy can be infiltrated under a significantly low-temperature condition of about 600° C. as compared to when it is diffused/infiltrated under a high-temperature atmosphere of greater than or equal to 1000° C., it is possible to suppress coarsening of the main phase (i.e., crystal grains). This also contributes to an improvement in the coercivity. In particular, unlike a sintered magnet, a nanocrystalline magnet will, when placed under a high-temperature atmosphere of about 800° C. for about 10 minutes, have significantly coarsened crystal grains. Thus, a modifying alloy is desirably infiltrated under a temperature condition of about 600° C. It should be noted that the liquid-phase infiltration time is preferably greater than or equal to 30 minutes. The coercivities of rare-earth magnets can be arranged by using a commonly known Kronmuller formula (i.e., $Hc=\alpha Ha-NMs$, where Hc denotes coercivity, $\alpha$ denotes a factor attributable to the separation property (between the nanocrystalline grains) of the main phase, Ha denotes magnetocrystalline anisotropy (which is specific to the main-phase material), N denotes a factor attributable to the grain size of the main phase, and Ms denotes saturation magnetization (which is specific to the main-phase material)). According to the above formula, when a modifying alloy is infiltrated in a short time, N will not change and only a will increase. Meanwhile, only after a modifying alloy is infiltrated in a long time that is greater than or equal to 30 minutes, N will decrease and a will increase, whereby the coercivity effectively improves.

When the aforementioned change in the inner structure of the molded body occurs, the molded body obtained through hot plastic processing will easily have a structure in which the crystal grains are perpendicular with respect to the orientation direction and are flat, and grain boundaries that are substantially parallel with the anisotropy axis tend to be curved or bent, and thus are not formed by specific planes. Meanwhile, as the time elapses after a melt of a modifying alloy starts to liquid-phase infiltrate into the grain boundary phase in the molten state, the interfaces between the crystal grains become clearer, and magnetic separation between the crystal grains progresses, and thus the coercivity improves. However, while such a change in the structure is occurring, each crystal grain still has a structure in which planes that are parallel with the anisotropy axis are not yet formed by specific planes.

In the stage where a change in the inner structure of the molded body is complete, each crystal grain, when viewed from a direction perpendicular to the anisotropy axis, has a plane that is quadrilateral in shape or has a close shape thereto, and the surface of the crystal grain is polyhedral (i.e., a hexahedron or an octahedron, or further, a close solid thereto) that is surrounded by low-index (Miller-index) planes. For example, it has been identified by the inventors that when the surface of the crystalline grain is hexahedral, the orientation axis is formed along the (001) plane (i.e., the easy direction of magnetization (i.e., c-axis) is located along the top and bottom planes of the hexahedron), and side planes are formed by (110), (100), or Miller indices that are close thereto.

As another example of the rare-earth magnet in accordance with the present invention, an embodiment represented by the following formula (the aforementioned Kronmuller formula), in which $\alpha$ is greater than or equal to 0.42 and N is less than or equal to 0.90, is given. Herein, $$Hc=\alpha Ha-NMs,$$

where He denotes coercivity, $\alpha$ denotes a factor attributable to the separation property (between the nanocrystalline grains) of the main phase, Ha denotes magnetocrystalline anisotropy (which is specific to the main-phase material), N denotes a factor attributable to the grain size of the main phase, and Ms denotes saturation magnetization (which is specific to the main-phase material).

This embodiment concerns the arrangement of the coercivities of rare-earth magnets using the aforementioned Kronmuller formula.

In the aforementioned rare-earth magnet in accordance the present invention, the Nd-Z alloy, which is a modifying alloy for the grain boundary phase, contains no heavy rare-earth elements such as Dy or Tb. Thus, the melting point can be significantly reduced than when a Dy alloy or the like is used.

As described above, as examples of modifying alloys, Cu and Al can be given as examples of metallic elements that have about an equal melting point to the grain boundary phase and have a relatively low source material cost.

When the modifying alloy is a Nd—Cu alloy, the eutectic point thereof is about 520° C., which is about equal to the melting point of the grain boundary phase. Thus, it is possible to, by setting the temperature atmosphere to 520 to 600° C., melt the grain boundary phase and also melt the Nd—Cu alloy, and thus cause liquid-phase infiltration of a melt of the Nd—Cu alloy into the grain boundary phase, whereby a grain-boundary-phase Nd—X alloy (where X is a metallic element other than heavy rare-earth elements) is formed in which the grain boundary phase containing Nd—Co, Nd—Fe, Nd—Ga, Nd—Co—Fe, or Nd—Co—Fe—Ga, or a mixture thereof is partially or entirely modified by the Nd—Cu alloy. It should be noted that "520 to 600° C." herein includes a temperature range of ±5% for which errors due to the production conditions (i.e., the room temperature, the conditions of a production apparatus, the temperature thereof, and the like) are taken into consideration.

Meanwhile, when the modifying alloy is a Nd—Al alloy, the melting point thereof is 640 to 650° C. (the eutectic point is 640° C.), which is slightly higher than the melting point of the grain boundary phase. Thus, when the temperature atmosphere is set to 640 to 650° C., the grain boundary phase is melted and the Nd—Al alloy is also melted, and thus a melt of the Nd-Al alloy can be caused to liquid-phase infiltrate into the grain boundary phase, whereby a grain-boundary-phase Nd—X alloy (where X is a metallic element other than heavy rare-earth elements) is formed in which the grain boundary phase containing Nd—Co, Nd—Fe, Nd—Ga, Nd—Co—Fe, or Nd—Co—Fe—Ga, or a mixture thereof is partially or entirely modified by the Nd—Al alloy. It should be noted that "640 to 650° C." herein includes a temperature range of ±5% for which various errors are taken into consideration.

Further, the Nd—Cu alloy or the Nd—Al alloy is preferably caused to liquid-phase infiltrate by 5 to 15 mass % with respect to the mass of the molded body.

The inventors have, as a result of measuring the coercivity of a rare-earth magnet for when a melt of a Nd—Cu alloy or a Nd—Al alloy is caused to liquid-phase infiltrate in the temperature range of a less than 600° C. (575° C.) to 650° C., confirmed a tendency that the coercivity will increase depending on the amount of infiltration of the modifying alloy. Further, as a result of conducting a more detailed analysis, the inventors have confirmed that when an (about) 5 mass % modifying alloy is infiltrated with respect to the mass of the molded body before the infiltration, the inflection point of the coercivity curve will change, and further, when an (about) 15 mass % modifying alloy is infiltrated, the coercivity curve will be saturated to substantially the maximum coercivity.

It has been identified that, based on the general tendency that the higher the coercivity, the lower the magnetization, the amount of the modifying alloy is preferably (about) 10 mass % or less from the perspective of the maximum energy product BHmax. Thus, (about) 15 mass % for when the coercivity performance is prioritized is defined as the upper limit value of the modifying alloy, and (about) 5 mass % for when both the adequate coercivity performance and the maximum magnetic energy product BHmax are prioritized is defined as the lower limit value of the modifying alloy.

The inventors have further verified the coercivity performance and the magnetization performance of a rare-earth magnet for when the amount of infiltration of a modifying alloy, such as a Nd—Cu alloy or a Nd—Al alloy, and the processing temperature thereof are changed.

Consequently, for the Nd—Cu alloy, for example, it has been confirmed that when the amount of infiltration of the alloy is greater than or equal to 10 mass %, high coercivity performance is obtained at around 600° C. that is the melting point of the alloy, and the amount of decrease in the magnetization is small.

As described above, for the rare-earth magnet in accordance with the present invention, plane indices of the surfaces of the nanocrystalline grains are changed while coarsening of the nanocrystalline grains is suppressed at the same time using a production method that is based on the novel technical idea of liquid-phase infiltrating a melt of a modifying alloy, which contains no heavy rare-earth elements such as Dy or Tb and has a relatively low melting point, into the grain boundary phase in the molten state, whereby the rare-earth magnet has nanocrystalline grains that are polyhedral, such as hexahedrons, each of which is surrounded by low-index planes, and the nanocrystalline grains are precisely magnetically separated from each other by the modified grain boundary phase.

Advantageous Effects of Invention

As can be understood from the foregoing descriptions, according to the rare-earth magnet and the production method therefor of the present invention, the magnet includes a RE-Fe—B-based main phase with a nanocrystalline structure (where RE is at least one of Nd or Pr) and a grain boundary phase around the main phase, the grain boundary phase containing a RE-X alloy (where X is a metallic element other than heavy rare-earth elements). Crystal grains of the main phase are oriented along the anisotropy axis, and each crystal grain of the main phase, when viewed from a direction perpendicular to the anisotropy axis, has a plane that is quadrilateral in shape or has a close shape thereto. A low-melting-point modifying alloy, such as a Nd—Cu alloy or a Nd—Al alloy, that contains no heavy rare-earth elements such as Dy or Tb is used, and a melt of the modifying alloy is caused to liquid-phase infiltrate into the grain boundary phase in the molten state, whereby it is possible to suppress coarsening of the nanocrystalline grains that form the main phase, and thus provide a rare-earth magnet with excellent coercivity performance and magnetization performance without using expensive heavy rare-earth metals.

BRIEF DESCRIPTION OF DRAWINGS

FIG. 2(*a*) is a view illustrating the micro-structure of a sintered body shown in FIG. 1(*b*), and FIG. 2(*b*) is a view showing the micro-structure of a molded body in FIG. 1(*c*);

DESCRIPTION OF EMBODIMENTS

Hereinafter, embodiments of a rare-earth magnet of the present invention and a method for producing the same will be described with reference to the drawings.

(Method for Producing Rare-Earth Magnet)

Figure 1:
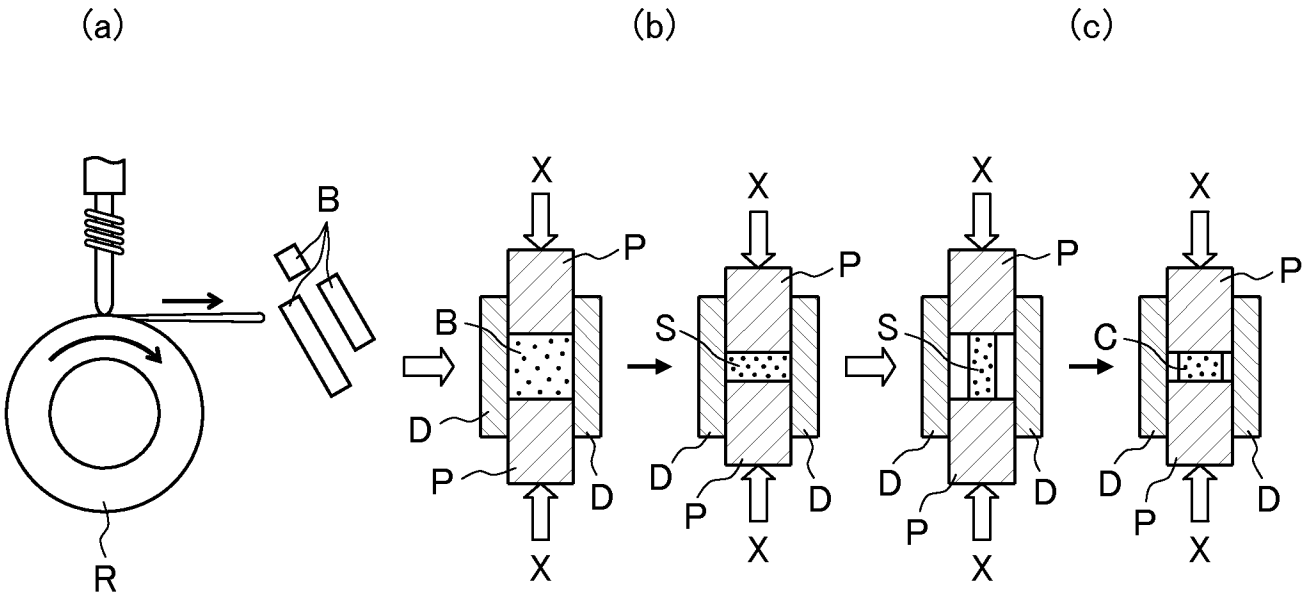
FIGS. 1(*a*), (*b*), and (*c*) are schematic views sequentially illustrating a first step of a production method of the present invention for producing a rare-earth magnet of the present invention.
Figure 3:
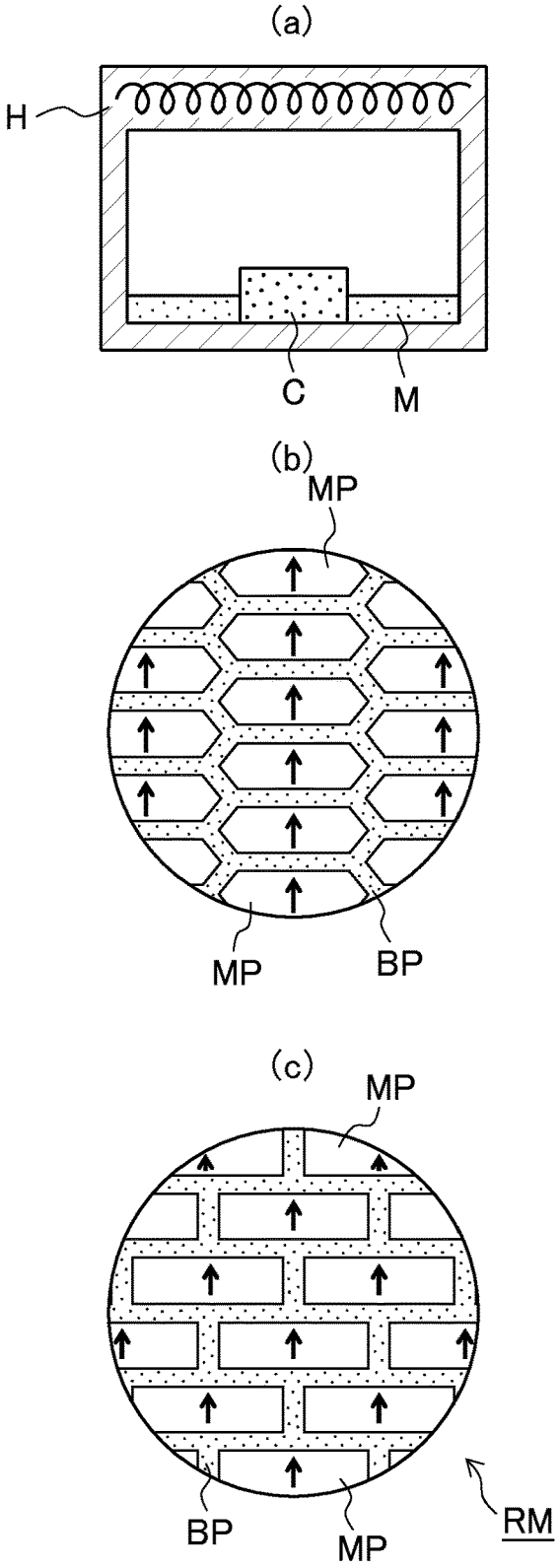
FIG. 3(*a*) is a view illustrating a second step of the production method, FIG. 3(*b*) is a view illustrating the micro-structure of a rare-earth magnet whose structure is being modified by a modifying alloy, and FIG. 3(*c*) is a view illustrating the micro-structure of the rare-earth magnet whose structure has been modified by the modifying alloy (i.e., the rare-earth magnet of the present invention)

FIGS. 1(*a*), (*b*), and (*c*) are schematic views sequentially illustrating a first step of a method for producing a rare-earth magnet of the present invention, and FIG. 3(*a*) is a view illustrating a second step of the production method. In addition, FIG. 2(*a*) is a view illustrating the micro-structure of a sintered body shown in FIG. 1(*b*), and FIG. 2(*b*) is a view illustrating the micro-structure of the molded body in FIG. 1(*c*). Further, 3(*b*) is a view illustrating the micro-structure of a rare-earth magnet whose structure is being modified by a modifying alloy, and FIG. 3(*c*) is a view illustrating the micro-structure of the rare-earth magnet whose structure has been modified by the modifying alloy (i.e., the rare-earth magnet of the present invention).

As shown in FIG. 1(*a*), an alloy ingot is melted at high frequency through single-roll melt-spinning in a furnace (not shown) with an Ar gas atmosphere whose pressure has been reduced to 50 kPa or less, and then a molten metal with a composition that provides a rare-earth magnet is sprayed at a copper roll R to produce a quenched thin strip B (i.e., a quenched ribbon). Then, the quenched thin strip B is coarsely ground.

A cavity that is defined by a carbide die D and a carbide punch P, which slides in the hollow space in the carbide die D, is filled with the quenched thin strip B that has been coarsely ground as shown in FIG. 1(*b*), and pressure is applied thereto (in the X direction) with the carbide punch P, and further, electric current is caused to flow therethrough in the pressure application direction for heating purposes, whereby a sintered body S is produced that includes a Nd—Fe—B-based main phase with a nanocrystalline structure (i.e., a crystal grain size of about 50 to 200 nm) and a grain boundary phase around the main phase, the grain boundary phase containing a Nd—X alloy (where X is a metallic element).

Herein, the Nd—X alloy that forms the grain boundary phase is an alloy of Nd and at least one of Nd, Co, Fe, or Ga, and contains, for example, one of Nd—Co, Nd—Fe, Nd—Ga, Nd—Co—Fe, or Nd—Co—Fe—Ga, or a mixture of two or more of them, and thus is in the Nd-rich state.

As shown in FIG. 2(*a*), the sintered body S exhibits an isotropic crystalline structure in which the grain boundary phase BP fills the gaps between the nanocrystalline grains MP (i.e., the main phase). Herein, the carbide punch P is made to abut the end face of the sintered body S in the longitudinal direction (in FIG. 1(*b*), the horizontal direction corresponds to the longitudinal direction) as shown in FIG. 1(*c*) to impart anisotropy to the sintered body S, and then hot plastic processing is performed with pressure applied (in the X direction) with the carbide punch P, whereby a molded body C with a crystalline structure having anisotropic nanocrystalline grains MP is produced as shown in FIG. 2(*b*) (hereinabove, the first step).

It should be noted that when the processing degree (i.e., compressibility) of the hot plastic processing is high, for example, when the compressibility is greater than or equal to about 10%, such processing may be called hot high-strength processing or be simply called high-strength processing.

In the crystalline structure of the molded body C shown in FIG. 2(*b*), the nanocrystalline grains MP have flat shapes, and interfaces that are substantially parallel with the anisotropy axis are curved or bent, and thus are not formed by a specific planes.

Next, as shown in FIG. 3(*a*), the produced molded body C is stored in a high-temperature furnace H with a built-in heater, and a modifying alloy M that contains no heavy rare-earth elements such as Tb (i.e., a Nd-Z alloy (where Z is a metallic element other than heavy rare-earth elements)) is brought into contact with the molded body C, and then, the furnace is set to a high-temperature atmosphere.

Herein, for the Nd-Z alloy, one of a Nd—Cu alloy or a Nd—Al alloy is used.

The melting point of the grain boundary phase containing Nd—Co, Nd—Fe, Nd—Ga, Nd—Co—Fe, or Nd—Co—Fe—Ga, or a mixture thereof varies depending on the components or the ratio of the components, but is approximately around 600° C. (i.e., in the range of about 550° C. to 650° C. for which such variations are taken into consideration).

When a Nd—Cu alloy is used as a modifying alloy, the eutectic point thereof is about 520° C. that is substantially equal to the melting point of the grain boundary phase BP. Thus, when the high-temperature furnace H is set to a temperature atmosphere of 520 to 600° C., the grain boundary phase BP will melt and the Nd—Cu alloy, which is the modifying alloy, will also melt.

The melt of the molten Nd—Cu alloy is caused to liquid-phase infiltrate into the grain boundary phase BP in the molten state. Thus, the grain boundary phase, which contains Nd—Co, Nd—Fe, Nd—Ga, Nd—Co—Fe, or Nd—Co—Fe—Ga, or a mixture thereof, that is partially or entirely modified by the Nd—Cu alloy is formed.

As described above, as a melt of a modifying alloy is caused to liquid-phase infiltrate into the grain boundary phase BP in the molten state, the diffusion efficiency and the diffusion speed are significantly superior to when Dy—Cu alloys and the like are solid-phase diffused into the grain boundary phase, and thus diffusion of a modifying alloy in a shorter time is possible.

When a Nd—Al alloy is used as a modifying alloy, the melting point thereof is 640 to 650° C. (and the eutectic point thereof is 640° C.), which is slightly higher than the melting point of the grain boundary phase BP. Thus, when the temperature atmosphere is set to 640 to 650° C., it is possible to melt the grain boundary phase BP and also melt the Nd—Al alloy, and thus cause a melt of the Nd—Al alloy to liquid-phase infiltrate into the grain boundary phase, whereby the grain boundary phase, which contains Nd—Co, Nd—Fe, Nd—Ga, Nd—Co—Fe, or Nd—Co—Fe—Ga, or a mixture thereof, that is partially or entirely modified by the Nd—Al alloy is formed.

When the melt of the modifying alloy has been caused to liquid-phase infiltrate into the grain boundary phase, and a given period of time has elapsed, the crystalline structure of the molded body C shown in FIG. 2(*b*) will change, so that, as shown in FIG. 3(*b*), interfaces between the crystal grains MP become clearer and magnetization separation between the crystal grains MP and MP progresses, and thus the coercivity improves. However, in the mid stage of the modification of the structure by the modifying alloy shown in FIG. 3(*b*), interfaces that are substantially parallel with the anisotropy axis are not formed (i.e., are not formed by specific planes).

At the stage where the modification by the modifying alloy has sufficiently progressed, interfaces (i.e., specific planes) that are substantially parallel with the anisotropy axis are formed as shown in FIG. 3(*c*), whereby a rare-earth magnet RM whose crystal grains MP, when seen from a direction perpendicular to the anisotropy axis (i.e., a direction from which FIG. 3(*c*) is seen), are rectangular in shape or have a close shape thereto is formed.

As described above, the rare-earth magnet RM of the present invention obtained with the production method of the present invention is considered to have improved coercivity because, as a molded body that has been obtained by applying hot plastic processing to a sintered body to impart anisotropy thereto is used, and a melt of a Nd—Cu alloy or a Nd—Al alloy, which is a modifying alloy containing no heavy rare-earth elements, is caused to liquid-phase infiltrate into the grain boundary phase in the molten state, the residual strains that have been produced by the hot plastic processing will come into contact with the melt of the modifying alloy and thus are removed, and further, a reduction in the crystal grain size as well as magnetization separation between the crystal grains progresses.

In addition, since a modifying alloy that contains no heavy rare-earth elements such as Tb and has a melting point that is about equal to the melting point of the grain boundary phase is used, when both the grain boundary phase and the modifying alloy are melted at a relatively low temperature of about 600° C., coarsening of the nanocrystalline grains is suppressed, and this also contributes to an improvement in the coercivity. Further, since heavy rare-earth elements such as Tb are not used, the material cost can be significant low, which in turn leads to a significant reduction in the production cost of the rare-earth magnet.

"Experiments of Measuring Coercivity by Varying the Amount of a Modifying Alloy Added to a Base Magnet, Results Thereof, and Arrangement of the Coercivities of Rare-Earth Magnets Using the Kronmuller Formula"

The inventors conducted experiments to identify the optimal range of the amounts of infiltration by preparing specimens of rare-earth magnets made of nanocrystalline magnets by using a Nd—Cu alloy as a modifying alloy and variously changing the temperature at the time of melting and the amount of infiltration of the modifying alloy.

Further, the inventors also made an attempt to arrange improvements in the coercivities of the rare-earth magnets using the Kronmuller formula.

It has been confirmed from a TEM image photograph that the specimen has a crystal grain size in the range of 50 to 200 nm. The sintered body was produced with a pressure of 300 MPa applied thereto for five minutes in a temperature atmosphere of 600° C. under a vacuum atmosphere. Such a sintered body was subjected to hot plastic processing at 780° C. at a strain rate of 1/s, whereby a molded body was produced.

Figure 4:
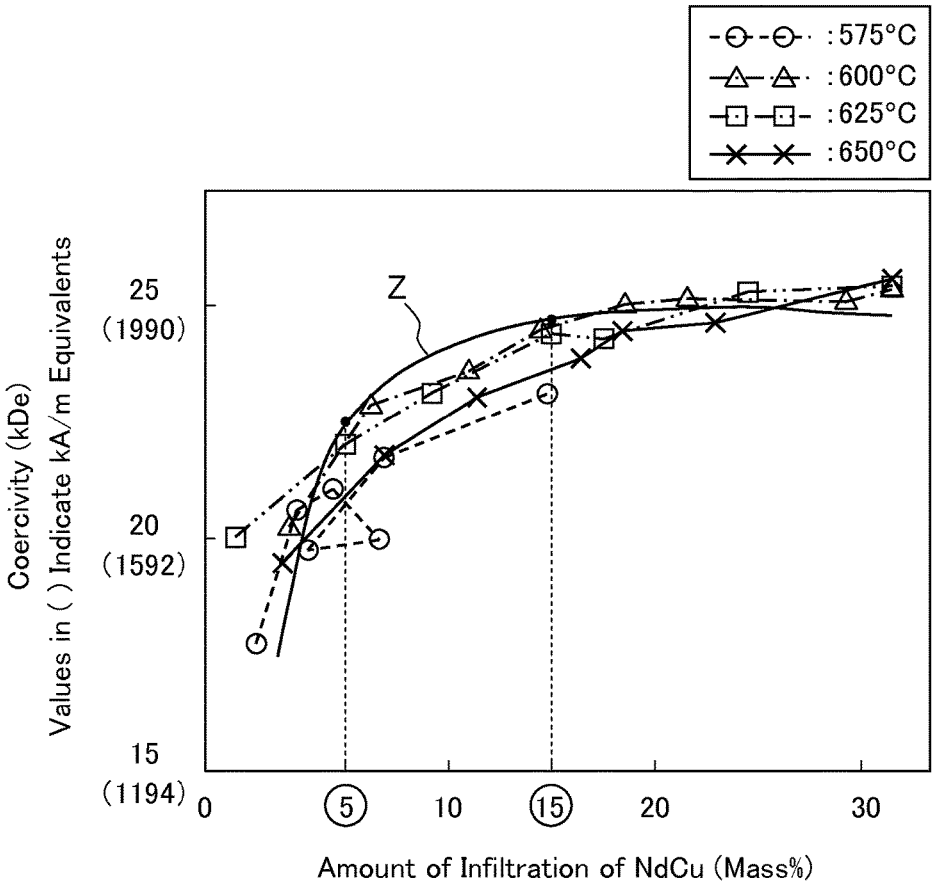
FIG. 4 shows the experimental results of the measurement of coercivity when a Nd—Cu alloy is used for a modifying alloy and the amount of the modifying alloy added to the base magnet (i.e., the molded body before the modifying alloy is infiltrated thereinto) and the temperature in the second step are changed.

The amount of the Nd—Cu alloy added to the obtained molded body was changed within the range of about 0 to 33 mass %, and the melting temperature in the second step was changed in four patterns that are 575° C., 600° C., 625° C., and 650° C. to fabricate a number of specimens, and then a graph was created on the basis of the test result of each specimen (i.e., the amount of the Nd—Cu alloy added and the coercivity measured with a pulse-excited magnetic property measurement device) for each melting temperature. FIG. 4 shows the test results and an approximated curve Z created from the test results of the four patterns.

FIG. 4 can confirm a tendency that coercivity increases depending on the amount of infiltration of the Nd—Cu alloy, which is a modifying alloy, in each case, and demonstrates that the coercivity curve has an inflection point when the modifying alloy is added by (about) 5 mass % with respect to the mass of the molded body before the infiltration, and further that the coercivity curve is saturated to substantially the maximum coercivity when the modifying alloy is added by (about) 15 mass %.

It has been identified by the inventors that, based on the general tendency that the higher the coercivity, the lower the magnetization, the amount of the modifying alloy is preferably (about) 10 mass % or less from the perspective of the maximum energy product BHmax. Thus, (about) 15 mass % for when the coercivity performance is prioritized can be defined as the upper limit value of the amount of the modifying alloy added (the amount of infiltration), and (about) 5 mass % for when both the adequate coercivity performance and the maximum magnetic energy product BHmax are prioritized can be defined as the lower limit value of the amount of the modifying alloy added.

It should be noted that even when a Nd—Al alloy is used as a modifying alloy, similar experimental results are considered to be obtained. Thus, a similar optimum range of the amount of the modifying alloy to be added can be defined.

Herein, the Kronmuller formula that is commonly known is shown below, and the coercivities of the rare-earth magnets that are based on the experimental results are arranged using the formula.

$$Hc=\alpha Ha-NMs, \quad \text{[Formula 1]}$$

where Hc denotes coercivity, α denotes a factor attributable to the separation property (between the nanocrystalline grains) of the main phase, Ha denotes magnetocrystalline anisotropy (which is specific to the main-phase material), N denotes a factor attributable to the grain size of the main phase, and Ms denotes saturation magnetization (which is specific to the main-phase material).

Figure 5:
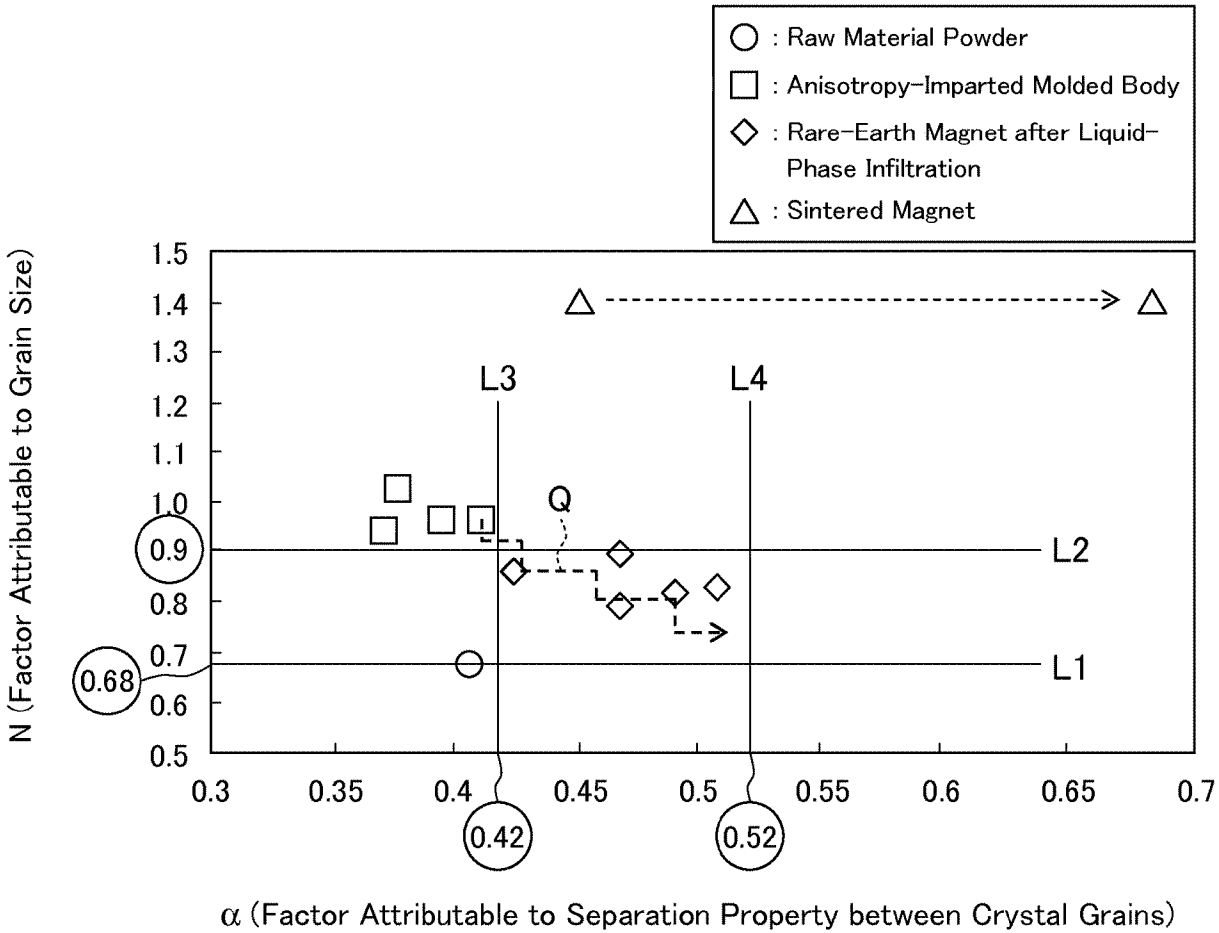
FIG. 5 is a graph in which the coercivities of specimens of rare-earth magnets are arranged using the Kronmuller formula.

FIG. 5 shows the coercivities of the experimental results of the aforementioned specimens that are arranged using the above formula.

The coordinate system shown in FIG. 5 is a coordinate system having the vertical axis N and the horizontal axis α, and the value of each specimen is plotted. It can be seen that with a reduction in the crystal grain size and an improvement in the magnetic separation property, a rare-earth magnet that is produced through liquid-phase infiltration of a melt of a Nd—Cu alloy tends to shift from the state of the molded body in the upper left region of the coordinates toward the lower right region of the coordinates.

More specifically, it can be understood from the graph that as the amount of infiltration of the modifying alloy increases, the value N decreases, and then, coercivity increases along with an increase with the value α (shifts in a stepwise manner in the lower right direction as indicated by a line Q in FIG. 5).

It has also been identified that as the value α is higher and the value N is lower, the heat resistance of the rare-earth magnet will improve.

In the graph, the crystal grain size of the rare-earth magnet will never be larger than that of the raw material powder. Thus, 0.68 can be defined as the lower limit of the value N (i.e., a lower limit graph L1). It should be noted that the raw material powder (i.e., a ribbon of the nanocrystalline grain structure) has a small factor N attributable to the grain size, and also has a small separation property a between the crystals.

There is no possibility that the separation property between the crystal grains will be lower than that of the molded body. Thus, 0.42 can be defined as the upper limit of the value α (i.e., a lower limit graph L3).

In addition, as the crystal grain size becomes smaller than that of the molded body, 0.9, which is the lower limit value of the crystal grain size of the molded body can be defined as the upper limit of the value N (i.e., an upper limit graph L2) of the rare-earth magnet.

Further, the value α: 0.52, which indicates the most excellent separation property in the present experiment, can be defined as the upper limit of the value α (i.e., an upper limit graph L4).

It should be noted that as shown in FIG. 5, although a sintered magnet has a high separation property between the grains (i.e., αis large), the factor N attributable to the grain size is large, and the grain size of the sintered magnet does not change during the formation process. Thus, although the separation property between the grains will improve, an improvement in the grain size factor cannot be expected (N remains to be 1.4).

FIG. 5 also shows that when the molded body obtained through hot plastic processing is left as is, the ranges of a and N will remain: $\alpha<0.42$ and $N>0.9$.

As described above, when a Nd—Cu alloy or a Nd—Al alloy is used and the amount of infiltration thereof is adjusted appropriately, it is possible to adjust the balance between magnetization and coercivity. Thus, when a rare-earth magnet with high coercivity is pursued or when a rare-earth magnet with excellent coercivity and magnetization and with high maximum energy product is pursued, for example, it is possible to design a rare-earth magnet with optimum performance in accordance with the required performance.

"Experiments of Measuring Coercivity and Magnetization by Changing the Amount of a Modifying Alloy Added to a Base Magnet, and Results Thereof"

Figure 6:
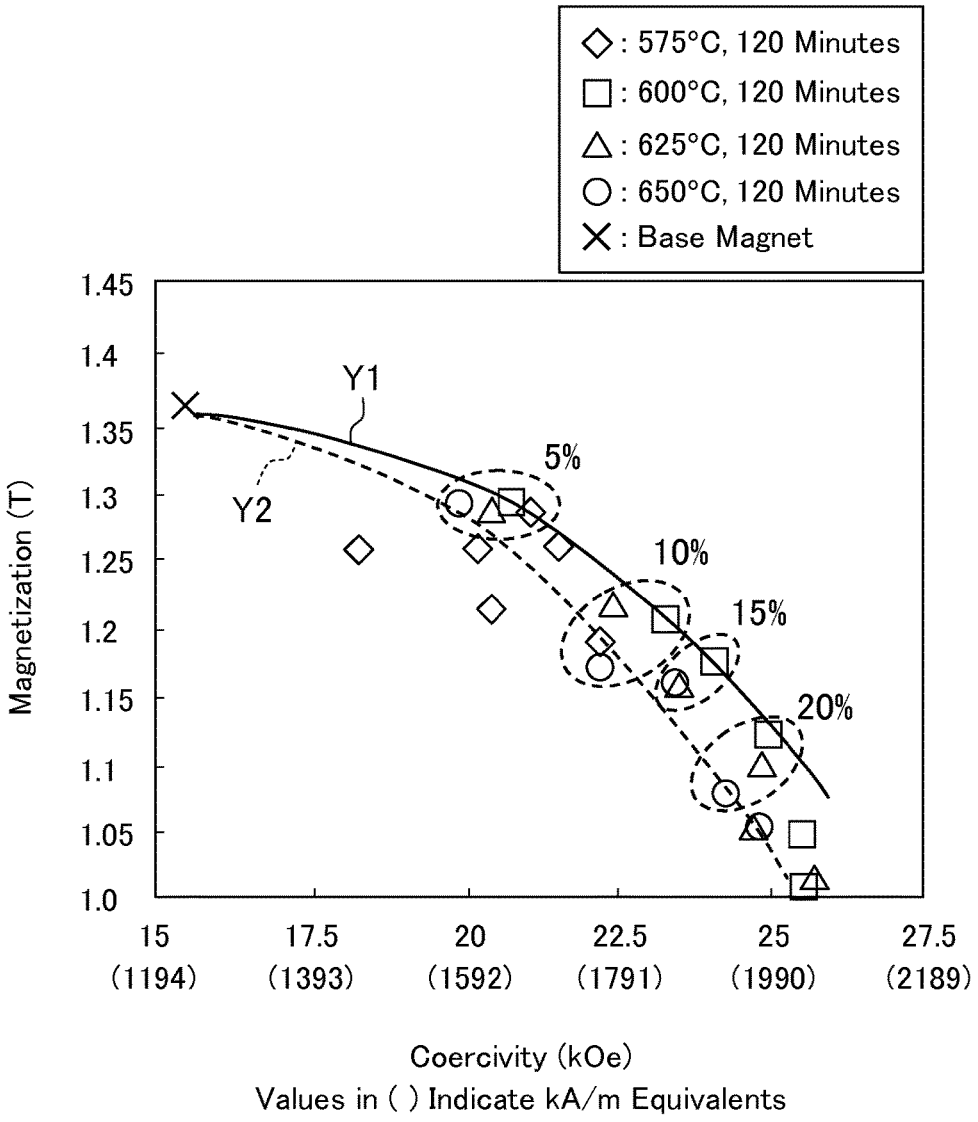
FIG. 6 shows the experimental results of the measurement of coercivity and magnetization for when a Nd—Cu alloy is used for a modifying alloy and the amount of the modifying alloy added to the base magnet and the temperature in the second step are changed.

The inventors have further conducted measurements of magnetization in addition to coercivity in the aforementioned experiments, and plotted the experimental results on the coercivity-magnetization coordinate system, and then verified the correlation of the optimal values between the amount of the modifying metal (i.e., a Nd—Cu alloy) added and the temperature conditions in the second step. FIG. 6 shows the coercivity-magnetization coordinate system showing the experimental results.

FIG. 6 can confirm a general tendency that as the amount of the Nd—Cu alloy added changes from 5 mass % to 20 mass %, magnetization decreases and coercivity improves. It should be noted that a curve Y1 represents a line that connects the plotted value for each amount of addition when the melting temperature in the second step is 600° C., and a curve Y2 represents a line that connects the plotted value for each amount of addition when the melting temperature is 650° C.

When the amount of the alloy added is 5 mass %, in the four cases where the melting temperature in the second step is 575° C., 600° C., 625° C., and 650° C., there is a general tendency that coercivity will decrease as the temperature is higher, and additionally, an improvement in magnetization cannot be confirmed (i.e., magnetization is at about the same level in all of the four cases).

In contrast, in the other cases where the amount of the alloy added is 10, 15, and 20 mass %, it can be confirmed that both magnetization and coercivity are the highest when the temperature is 600° C. (to be exact, magnetization of when the amount of the alloy added is 10 mass % is slightly higher than when the temperature is 625° C.).

Accordingly, when a Nd—Cu alloy is used as a modifying alloy, it is considered that the melting temperature in the second step is desirably set to 600° C. (which is a temperature greater than or equal to the eutectic point of the Nd—Cu alloy).

From the foregoing results, it is estimated that when a Nd—Al alloy is used as a modifying alloy, the melting temperature in the second step is desirably set to a temperature of 640 to 650° C. that is the melting temperature of the Nd—Al alloy.

"Results of Observation of the Crystalline Structure of a Rare-Earth Magnet Obtained Through Sufficient Liquid-Phase Infiltration of a Melt of a Modifying Alloy into a Grain Boundary Phase in a Molten State"

The inventors captured TEM images of the structures of a molded body that has been produced through hot plastic processing, a rare-earth magnet that is being produced and in which a melt of a modifying alloy is caused to liquid-phase infiltrate into a grain boundary phase in a molten state for a given period of time, and further a rare-earth magnet that has been produced through sufficient liquid-phase infiltration of a melt of a modifying alloy into a grain boundary phase in a molten state. Then, the inventors observed changes in the shapes of the nanocrystalline grains.

Herein, a sintered body was produced by grinding a quenched thin strip (i.e., a RE-TM-B-M alloy, where RE is Nd—Pr, TM is Fe—Co, and M is Ga), which has been produced through a liquid quenching method, so that the central grain size becomes about 1000 μm, and filling a cavity defined by a carbide die and a carbide punch with the ground quenched thin strip B, and then performing baking while applying pressure under the conditions of a temperature of 500 to 700° C. and a pressure of 50 to 500 MPa for a time of 10 to 600 seconds. Then, the sintered body was subjected to hot plastic processing under the conditions of a temperature of 600 to 800° C. and a strain rate of 100/s, whereby a molded body with magnetic anisotropy imparted thereto was produced.

Figure 7:
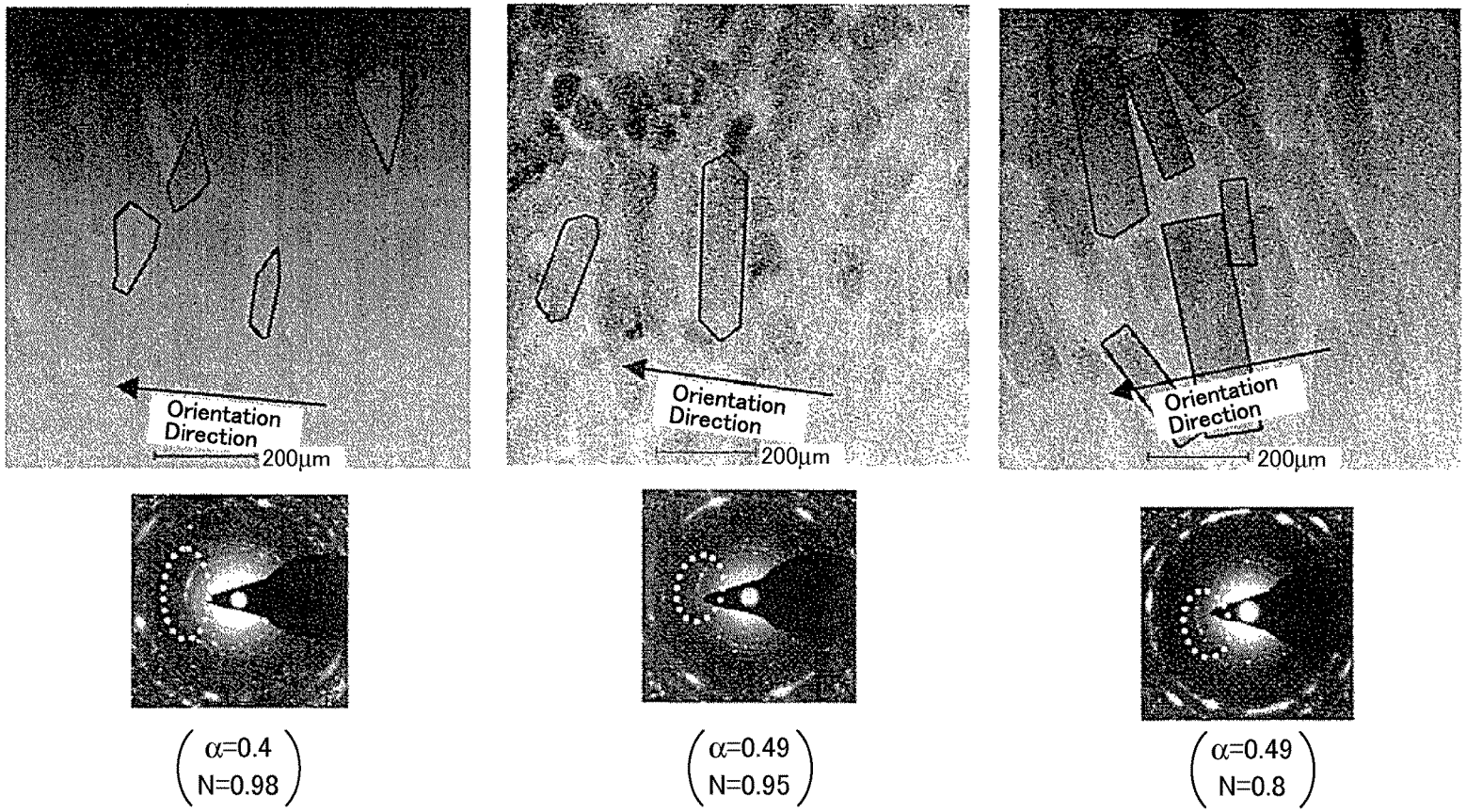
FIGS. 7 are TEM image photographs of the structure of a rare-earth magnet in the production process; specifically, FIG. 7(*a*) is a photograph of a molded body, FIG. 7(*b*) is a photograph of after 10 minutes have elapsed after modification by a modifying alloy, and FIG. 7(*c*) is a photograph of after 30 minutes have elapsed after modification by a modifying alloy.

Such a molded body was stored in a high-temperature furnace, and a 10 to 20 mass % Nd—Cu alloy (i.e., Nd70Cu30) as a modifying alloy was brought into contact with respect to the mass of the molded body, and then the temperature in the furnace was set to about 600° C., so that a melt of the modifying alloy was caused to liquid-phase infiltrate into the grain boundary phase in the molten state. Then, a TEM image of the molded body was captured and the coercivity thereof was also measured. A TEM image of each rare-earth magnet after 10 minutes have elapsed, and further, after 30 minutes have elapsed from the liquid-phase infiltration was captured. FIGS. 7(*a*), 7(*b*), and 7(*c*) show the respective TEM images.

The molded body in FIG. 7(*a*) has a coercivity of 16 kOe (i.e., 1274 kA/m). It can be confirmed that the crystal grains have a structure in which the grains are perpendicular with respect to the orientation direction and are flat, while grain boundaries that are substantially parallel with the anisotropy axis are curved or bent, and thus are not formed by specific planes.

In contrast, the rare-earth magnet shown in FIG. 7(*b*) that is being modified has an improved coercivity of 20 kOe (i.e., 1592 kA/m), and it can be confirmed that interfaces between the crystal grains are clearer than in FIG. 7(*a*), and magnetization separation between the crystal grains has progressed. However, interfaces that are substantially parallel with the anisotropy axis are not formed (i.e., the grain boundaries are not formed by specific planes).

A rare-earth magnet shown in FIG. 7(*c*) that has been sufficiently modified by a modifying alloy has an improved coercivity of 25 kOe (i.e., 1990 kA/m). As shown in FIG. 7(*c*), it can be confirmed that interfaces (specific planes) that are substantially parallel with the anisotropy axis are formed, each crystal grain, when seen from a direction perpendicular to the anisotropy axis (i.e., a direction from which FIG. 7(*c*) is seen), exhibits a rectangular shape or a close shape thereto.

The surface of each nanocrystalline grain is polyhedral (i.e., a hexahedron or an octahedron, or further, a close solid thereto) that is surrounded by low-index planes. For example, it has been confirmed that when the surface of the nanocrystalline grain is hexahedral, the orientation axis is formed along the (001) plane, and side planes are formed by (110), (100), or Miller indices that are close thereto.

The observation results show that when a rare-earth magnet is produced with the aforementioned production method, it is possible to obtain a rare-earth magnet with a metal structure having nanocrystalline grains whose surfaces are polyhedral such as hexahedrons or octahedrons that are surrounded by low-index planes, and obtain a rare-earth magnet with excellent coercivity performance, in particular, excellent coercivity performance at high temperatures, and a high maximum energy product since a reduction in the crystal grain size as well as magnetic separation between the crystal grains is sufficiently achieved.

Although the embodiments of the present invention have been described in detail with reference to the drawings, specific structures are not limited thereto. The present invention includes design changes and the like that may occur within the scope and spirit of the present invention.

REFERENCE SIGNS LIST

R Copper roll
B Quenched thin strip (quenched ribbon)
D Carbide die
P Carbide punch
S Sintered body
C Molded body
H High-temperature furnace
M Modifying alloy
MP Main phase (nanocrystalline grains, crystal grains)
BP Grain boundary phase
RM Rare-earth magnet

The invention claimed is:

1. A rare-earth bulk magnet comprising:

a RE-Fe—B-based main phase with a nanocrystalline structure, the main phase having crystal grain size in a range of 50 nm to 300 nm, where RE is at least one of Nd or Pr; and; and a grain boundary phase around the main phase, the grain boundary phase containing a RE-X alloy, where X is a metallic element other than heavy rare-earth elements, wherein crystal grains of the main phase are oriented along an anisotropy axis, each crystal grain of the main phase, when viewed from a direction perpendicular to the anisotropy axis, has a plane that is quadrilateral in shape or has a close shape thereto, a solid shape of the crystal grain of the main phase has a (001) plane as a plane that is perpendicular to the anisotropy axis, and has (110), (100), or a close low-index plane thereto as a side plane, and a coercivity of the rare-earth bulk magnet satisfies the following formula (1):

$$Hc=\alpha Ha-NMs \quad (1),$$

wherein, in formula (1), Hc denotes coercivity, α denotes a factor attributable to a separation property between nanocrystalline grains of the main phase, Ha denotes magnetocrystalline anisotropy, which is specific to a material of the main phase, N denotes a factor attributable to a grain size of the main phase, and Ms denotes saturation magnetization, which is specific to the material of the main phase, and αis in a range of 0.42 to 0.52, and N is in a range of 0.68 to 0.90 and wherein the rare-earth bulk magnet is obtained by:

Step 1: sintering a powder, obtained through liquid quenching of a melt of a RE-Fe—B-based metal, at a temperature of 500 to 700° C., a pressure of 50 to 500 Mpa, and a time of 10 to 600 seconds to obtain a bulk sintered body having an isotropic crystalline structure; and Step 2: applying hot plastic processing to the bulk sintered body obtained in Step 1 at a temperature of 700 to 800° C., a predetermined plastic strain rate, a predetermine pressure and a predetermined processing time to obtain a molded body with magnetic anisotropy imparted thereto along the anisotropy axis, the molded body having the RE-Fe—B-based main phase and the grain boundary phase around the main phase; and Step 3: melting a RE-Z modifying alloy, where Z is a metallic element other than heavy rare-earth elements, for increasing coercivity of the molded body obtained in Step 3, together with the grain boundary phase, to cause liquid-phase infiltration of a melt of the RE-Z modifying alloy from a surface of the molded body, thereby obtaining the rare-earth bulk magnet, and wherein pressure is applied in Step 1 and Step 2 using a punch, and after the bulk sintered body is obtained in Step 1, an end face of the bulk sintered body is made to abut the punch so as to impart the anisotropy to the bulk sintered body during Step 2.

2. The rare-earth bulk magnet according to claim 1, wherein the RE-Z modifying alloy is a Nd—Cu alloy.

3. The rare-earth bulk magnet according to claim 1, wherein the RE-Z modifying alloy is a Nd—Al alloy.

4. The rare-earth bulk magnet according to claim 1, wherein X is at least one element selected from the group consisting of Co, Fe and Ga, and Z is an element selected from the group consisting of Cu and Al.

5. The rare-earth bulk magnet according to claim 1, wherein the RE-Z modifying alloy is a Nd—Cu alloy, and Step 3 includes melting the Nd—Cu alloy together with the grain boundary phase at a temperature of 520 to 600° C. to cause the liquid-phase infiltration of a melt of the Nd—Cu alloy.

6. The rare-earth bulk magnet according to claim 1, wherein the RE-Z modifying alloy is a Nd—Al alloy, and Step 3 includes melting the Nd—Al alloy together with the grain boundary phase at a temperature of 640 to 650° C. to cause the liquid-phase infiltration of a melt of the Nd—Al alloy.

* * * * *